US006373459B1

(12) United States Patent
Jeong

(10) Patent No.: US 6,373,459 B1
(45) Date of Patent: Apr. 16, 2002

(54) DEVICE AND METHOD FOR DRIVING A TFT-LCD

(75) Inventor: Kwoan Yel Jeong, Kyungsangbuk-do (KR)

(73) Assignee: LG Semicon Co., Ltd., Chungcheongbuk-do (KR)

( * ) Notice: Subject to any disclaimer, the term of this patent is extended or adjusted under 35 U.S.C. 154(b) by 0 days.

(21) Appl. No.: 09/324,776

(22) Filed: Jun. 3, 1999

(30) Foreign Application Priority Data

Jun. 3, 1998 (KR) ..... 98-20637

(51) Int. Cl.[7] ..... G09G 3/36

(52) U.S. Cl. ..... 345/100; 345/92; 345/98; 345/204

(58) Field of Search ..... 345/87–103, 204, 345/208–211; 327/333

(56) References Cited

U.S. PATENT DOCUMENTS 5,510,748 A * 4/1996 Erhart et al. ..... 327/530
5,578,957 A 11/1996 Erhart et al. ..... 327/333
5,604,510 A * 2/1997 Blanchard ..... 345/98
5,625,373 A * 4/1997 Johnson ..... 345/58
5,812,104 A * 9/1998 Kapoor et al. ..... 345/76
6,008,801 A * 12/1999 Jeong ..... 345/204
6,049,321 A * 4/2000 Sasaki ..... 345/99
6,259,425 B1 * 7/2001 Shimizu ..... 345/94

* cited by examiner

*Primary Examiner*—Lun-Yi Lao
(74) *Attorney, Agent, or Firm*—Birch, Stewart, Kolasch & Birch, LLP

(57) ABSTRACT

A device and method for driving a liquid crystal display (LCD). The device includes a mixer for temporarily storing digital picture signals of a plurality of channels and outputting the digital picture signals according to a predetermined order of polarity based on polarity control data, a latch unit for latching the digital picture signals output from the mixer based on predetermined pulse signals, a digital-to-analog (D/A) conversion unit for converting the digital picture signals output from the latch unit based on predetermined reference voltage signals, a storage unit for adding a predetermined value to the output signal of the D/A conversion unit when processing positive polarity signals, and a switching unit generating first and second polarity signals in a predetermined order based on the output signals of the storage unit.

21 Claims, 8 Drawing Sheets

FIG.9

| | ① | ② | ③ | ④ | ⑤ | ⑥ | ⑦ |
|---|---|---|---|---|---|---|---|
| V05 | Vref5 | x | x(=) | x | Vref0 | x | x(=) |
| V04 | Vref4 | x | x(=) | x | Vref1 | x | (=) |
| V03 | Vref3 | x | x(=) | x | Vref2 | x | (=) |
| V02 | Vref2 | x | x(=) | x | Vref3 | x | (=) |
| V01 | Vref1 | x | x(=) | x | Vref4 | x | (=) |
| V00 | Vref0 | x | x(=) | x | Vref5 | x | (=) |

DEVICE AND METHOD FOR DRIVING A TFT-LCD

BACKGROUND OF THE INVENTION

1. Field of the Invention

The present invention relates to a thin film transistor liquid crystal display (TFT-LCD) and, more particularly, to a device and method for driving a dot inversion source of a TFT-LCD.

2. Background of the Related Art

TFT-LCDs are widely used in monitors, TVs and the like, which require high picture quality. Generally, a dot inversion driving method has been used in the TFT-LCDs to obtain high picture quality. The dot inversion driving method requires the use of a high voltage of 10–12V in a circuit for driving a source, and the use of a high voltage device positioned at an output terminal or the use of a special circuit method to realize a typical CMOS process.

A conventional dot inversion circuit for driving a TFT-LCD will be described with reference to FIGS. 1 and 2. FIG. 1 is a schematic view illustrating a conventional circuit for driving a TFT-LCD and FIG. 2 is a schematic view illustrating an output buffer unit of the circuit shown in FIG. 1.

As shown in FIG. 1, the conventional circuit 50 for driving a TFT-LCD includes a first level shift unit 1 for shifting picture data $V_{SS}$–$V_{DD}$ indicative of gray level to picture data $V_{SS2}$–$V_{DD2}$ of certain levels, a first digital-to-analog (D/A) converter 2 for converting the signals output from the first level shift unit 1 to an analog picture signal of positive (+) polarity, a first sample and hold (S/H) unit 3 for sampling and holding the output of the first D/A converter 2, a second level shift unit 4 for shifting picture data $V_{SS}$–$V_{DD}$ indicative of gray level to picture data $V_{SS1}$–$V_{DD1}$ of certain levels, a second D/A converter 5 for converting the signals output from the second level shift unit 4 to an analog picture signal of positive (+) polarity, a second S/H unit 6 for sampling and holding the output of the second D/A converter 5, a third level shift unit 7 for shifting externally applied polarity (+, –) signals $V_{SS}$–$V_{DD}$ to certain signal level data $V_{SS2}$–$V_{DD2}$ and outputting a first enable signal ENS1 of high level, a fourth level shift unit 8 for shifting externally applied polarity (+,–) signals $V_{SS}$–$V_{DD}$ to certain signal level data $V_{SS1}$–$V_{DD1}$ and outputting a second enable signal ENS2 of low level, and an output buffer unit 9 for outputting one of the output signals OUT1 and OUT2 from the first and second S/H units 3 and 6 in response to the first and second enable signals ENS1 and ENS2.

As shown in FIG. 2, the output buffer unit 9 includes a first transistor Q1 for switching the output signal OUT1 of the first S/H unit 3 in response to the first enable signal ENS1 output from the third level shift unit 7, a second transistor Q2 for switching the output signal OUT2 of the second S/H unit 6 in response to the second enable signal ENS2 output from the fourth level shift unit 8, and third and fourth transistors Q3 and Q4 for respectively amplifying the signals output from the first and second transistors Q1 and Q2 at a predetermined gain.

The operation of the conventional circuit 50 for driving a source of a TFT-LCD will be described below.

The digital picture data of 4 bits, indicative of gray levels, are converted to predetermined levels $V_{SS2}$–$V_{DD2}$ by the first level shift unit 1, the first D/A converter 2 and the first S/H unit 3 to generate analog signals of positive (+) polarity. The digital picture data of 4 bits, indicative of gray levels, are converted to predetermined levels $V_{SS1}$–$V_{DD1}$ by the second level shift unit 4, the second D/A converter 5 and the second S/H unit 6 to generate analog signals of negative (–) polarity.

Externally applied polarity (+,–) signals are converted to predetermined levels $V_{SS2}$–$V_{DD2}$ and $V_{SS1}$–$V_{DD1}$ by the third and fourth level shift units 7 and 8 to generate and output the first and second enable signals ENS1, ENS2 to the output buffer unit 9. The output buffer unit 9 selects one of the output signals OUT1 and OUT2 from the first and second S/H units 3 and 6 in response to the first and second enable signals ENS1, ENS2, and applies the selected signal to a TFT-LCD data line.

In the conventional circuit 50, circuits for processing positive (+) polarity picture signals and negative (–) polarity picture signals are separately provided. Each of these circuits has low voltage devices with the voltage conversion width of the circuit reduced to 5V or less. In addition, a shield transistor is formed at the output terminal circuit to prevent the generation of high voltage signals between the gate and drain of the respective transistor constituting the output terminal circuit or between the source and the drain of the same.

Such a conventional driving circuit for driving a source of a TFT-LCD has the following problems.

In processing picture signals of one channel, since positive (+) polarity processors and negative (–) polarity processors are separately provided, the size of the driving circuit becomes large.

Furthermore, when the output buffer unit switches from a positive (+) polarity signal to a negative (–) polarity signal, a high voltage signal is instantly applied between the source and drain of the fourth transistor Q4. Further, when the output buffer unit switches from a negative (–) polarity signal to a positive (+) polarity signal, a high voltage signal is instantly applied between the source and drain of the third transistor Q3. These high voltage signals deteriorate the reliability of the conventional driving circuit.

SUMMARY OF THE INVENTION

Accordingly, the present invention is directed to a circuit for driving a TFT-LCD that substantially obviates one or more of the problems due to limitations and disadvantages of the related art.

An object of the present invention is to provide a circuit for driving a TFT-LCD, which simplifies circuit configuration and can be realized by a typical CMOS process.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a device for driving a TFT-LCD according to the present invention includes a mixer for temporarily storing digital picture signals of a plurality of channels and outputting the digital picture signals according to a predetermined order of polarity based on polarity control data, a latch unit for latching the digital picture signals output from the mixer based on predetermined pulse signals, a digital-to-analog (D/A) conversion unit for converting the digital picture signals output from the latch unit based on predetermined reference voltage signals, and a storage unit for adding a predetermined value to an output signal of the D/A conversion unit when processing positive polarity signals, and a switching unit generating first and second polarity signals in a predetermined order based on output signals of the storage unit.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 9 is a table showing output values of the power switch of FIG. 5 at different times set in FIG. 6.

DETAILED DESCRIPTION OF THE PREFERRED EMBODIMENTS

Reference will now be made in detail to the preferred embodiments of the present invention, examples of which are illustrated in the accompanying drawings.

Figure 1:
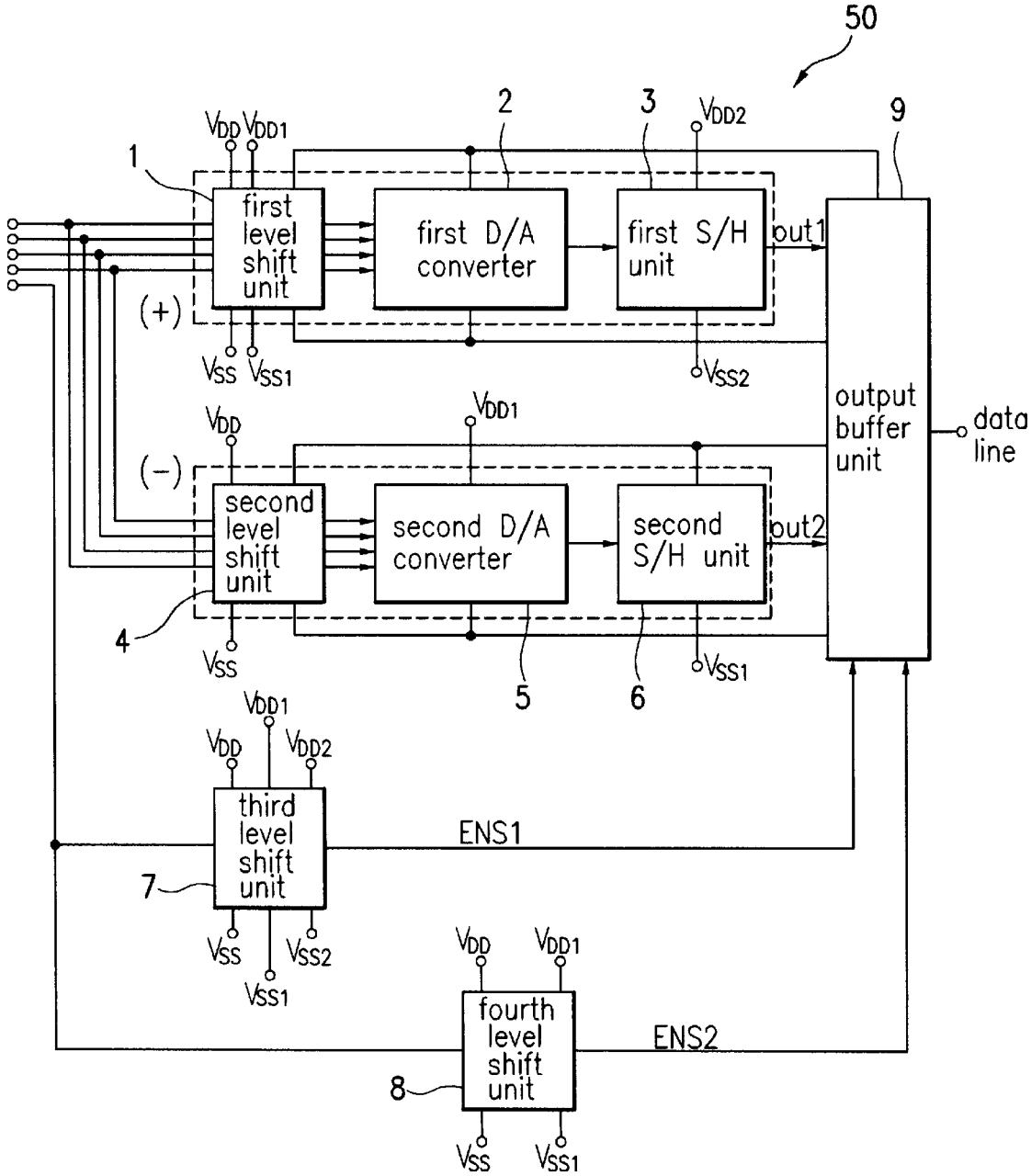
FIG. 1 Related Art
FIG. 1 is a block diagram of a conventional circuit for driving a TFT-LCD.
Figure 2:
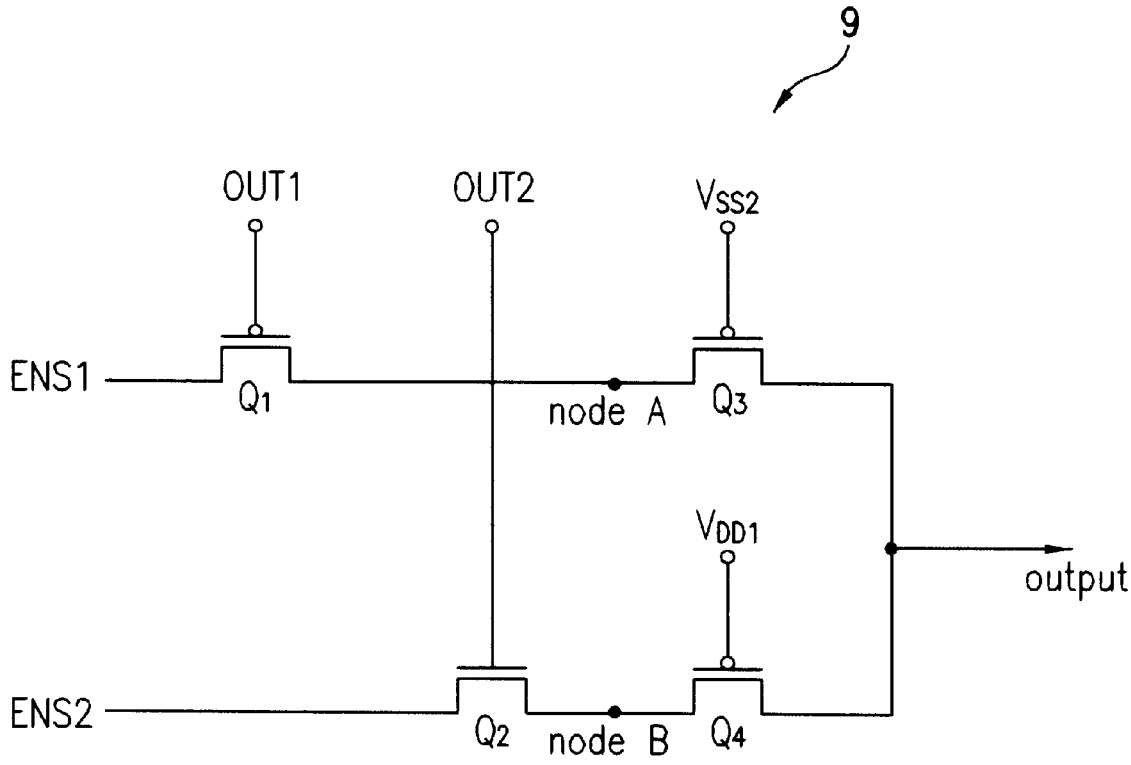
FIG.2 Related Art
FIG. 2 is a circuit diagram illustrating an output buffer unit of the circuit shown in FIG. 1.
Figure 3:
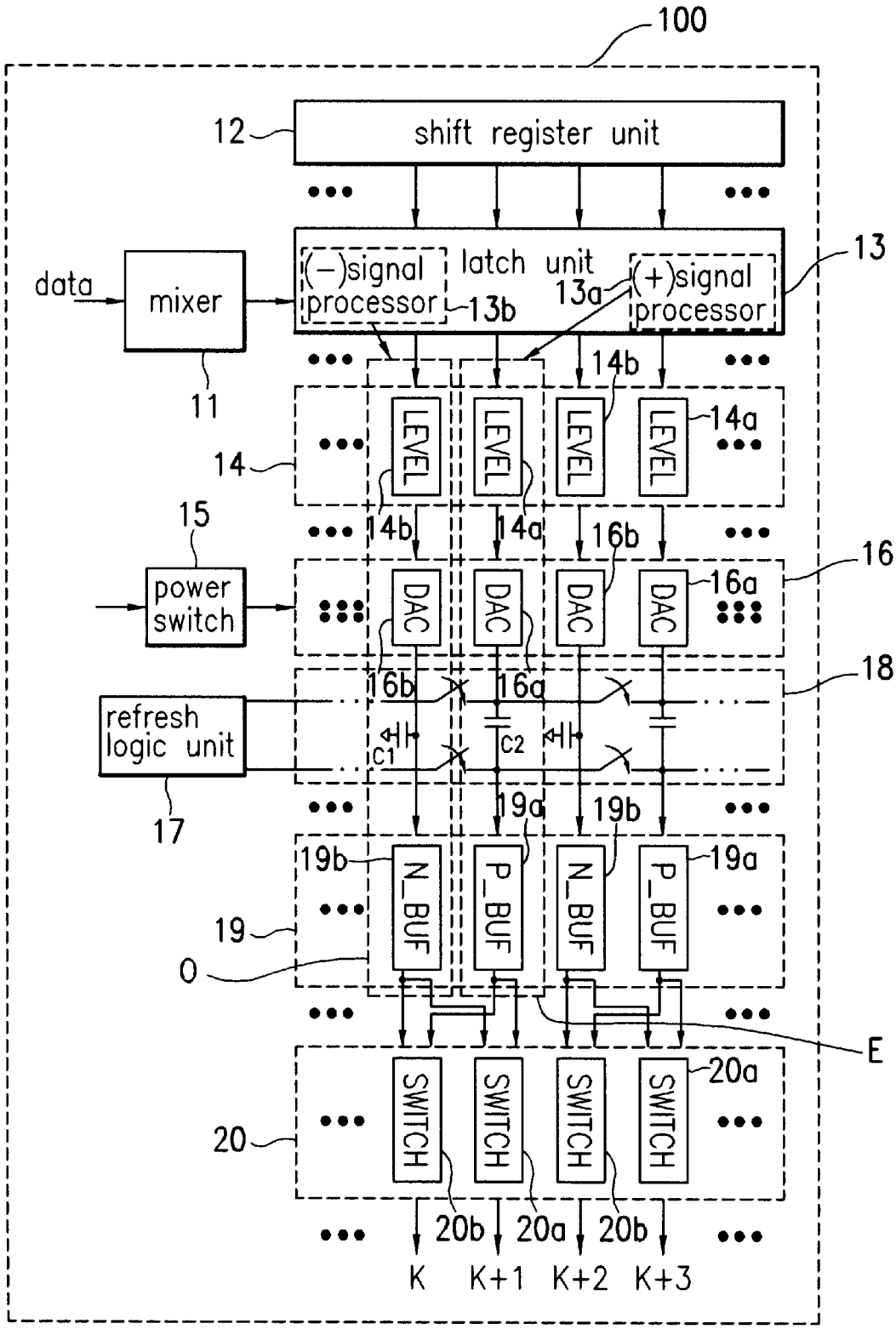
FIG. 3 is a circuit diagram of a device for driving a TFT-LCD according to a preferred embodiment of the present invention.

As shown in FIG. 3, a device 100 for driving a TFT-LCD according to a preferred embodiment of the present invention includes a mixer 11 for temporarily storing digital picture data of two or more input channels and sequentially outputting positive (+) polarity signals and negative (−) polarity signals in response to externally applied polarity data; a shift register unit 12 for sequentially outputting pulses having one period length of a clock signal; a latch unit 13 for latching the digital picture signals output from the mixer 11 based on the pulses output from the shift register unit 12, processing the same by a positive (+) polarity signal processor 13*a* and a negative (−) polarity signal processor 13*b*, and outputting signals $V_{SS}$–$V_{DD}$; a level shift unit 14, having a plurality of level shifters 14*a* corresponding to the number of TFT-LCD channels, for shifting the signals $V_{SS}$–$V_{DD}$ output from the latch unit 13 to signals $V_{SS1}$–$V_{DD1}$ to a predetermined level; a power switch 15 for outputting a plurality of externally applied reference voltage signals Vref (Vref0, Vref1 . . . ) in the order of high to low, or low to high values in response to control signals; a D/A conversion unit 16, having a plurality of digital-to-analog converters (DACs) 16*a* corresponding to the number of TFT-LCD channels, for converting the digital signals output from the level shifters 14*a* to analog signals in response to the reference voltage signals Vref output from the power switch 15; a storage unit 18, having capacitors C1, C2, . . . corresponding to the number of TFT-LCD channels (i.e., positive (+) polarity capacitors for processing positive (+) polarity signals and negative (−) polarity capacitors for processing negative (−) polarity signals) for adding a certain value Vx to the output value of the D/A conversion unit 16 when processing the positive (+) polarity signals; a refresh logic unit 17 for refreshing the positive (+) polarity capacitors to maintain the potential difference between the ends of the positive (+) polarity capacitors at a certain value Vx; a buffer unit 19, having a plurality of buffers 19*a*, 19*b* corresponding to the number of TFT-LCD channels, for respectively amplifying the output signals of the storage unit 18; and a switching unit 20, having a plurality of switches 20*a* corresponding to the number of TFT-LCD channels, for selecting one of a pair of buffers 19*a* and outputting a signal from the selected buffer.

In each of the level shift unit 14, the D/A converter 16, the storage unit 18 and the buffer unit 19, sub units therein in odd number lines process negative (−) polarity signals, while the sub units in even number lines process positive (+) polarity signals.

The elements of the device 100 according to the preferred embodiment of the present invention will be described in detail referring to FIGS. 4–8.

Figure 4:
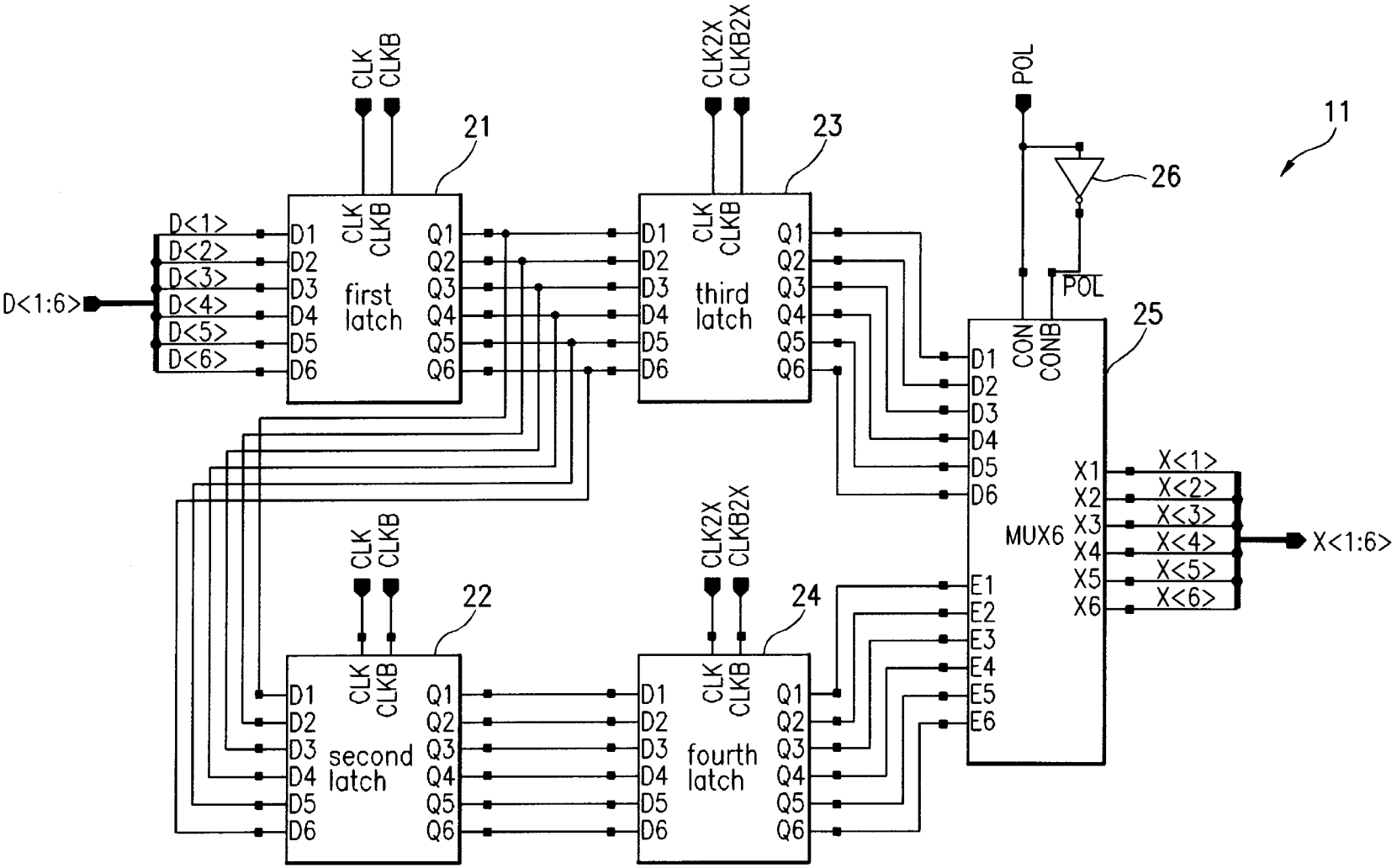
FIG. 4 is a detailed circuit diagram of a mixer of the device in FIG. 3.

As shown in FIG. 4, the mixer 11 includes a first latch 21 for latching bit data (e.g., 6 bit data) based on clock signals CLK and CLKB, a second latch 22 for latching the output signals of the first latch 21 based on the same clock signals CLK and CLKB applied to the first latch 21, a third latch 23 for latching the output signals of the first latch 21 based on clock signals CLK2X and CLKB2X corresponding to two times of the clock signals CLK and CLKB, respectively, a fourth latch 24 for latching the output signals of the second latch 22 based on the same clock signals CLK2X and CLKB2X applied to the third latch 23, and a multiplexer 25 for selecting one of the output signals of the third and fourth latches 23 and 24 based on a polarity signal POL input to a CON terminal and an inverted polarity signal $\overline{\text{POL}}$ input to a CONB terminal. An inverter 26 or the like inverts the polarity signal POL to the inverted polarity signal $\overline{\text{POL}}$.

Figure 5:
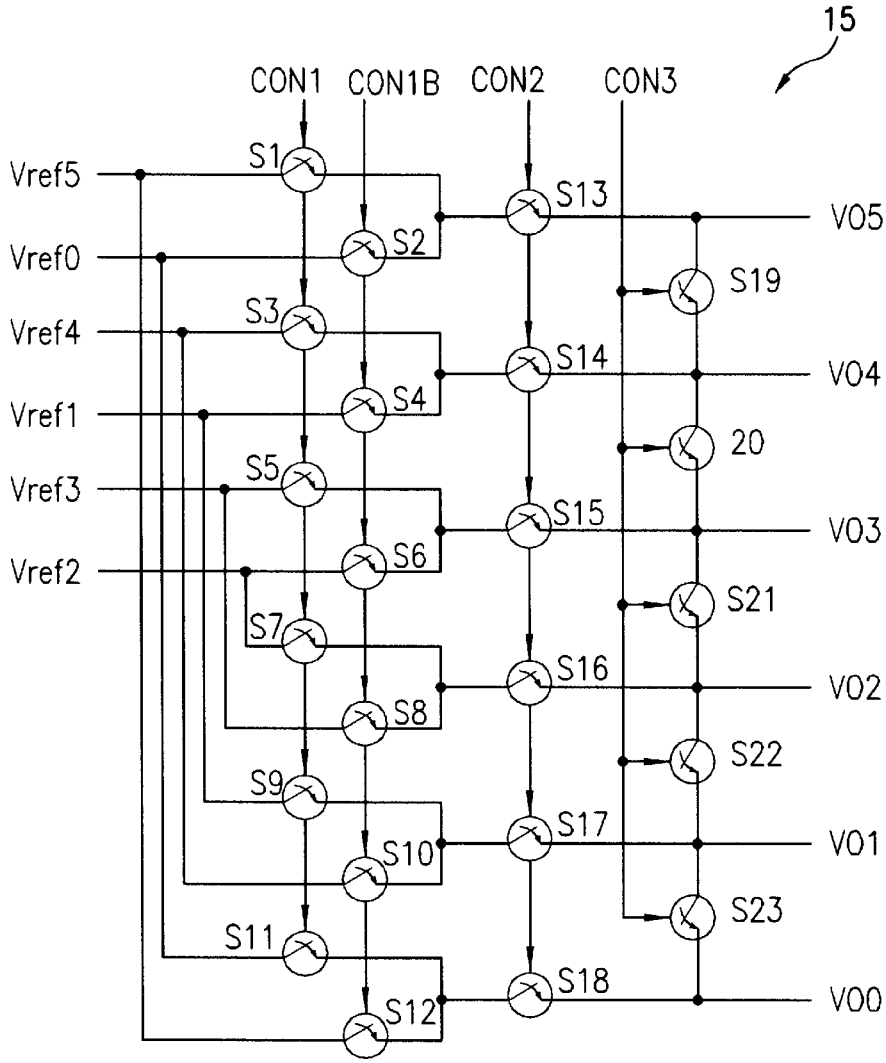
FIG. 5 is a detailed circuit diagram of a power switch of the device in FIG. 3.

As shown in FIG. 5, the power switch 15 includes a first switch S1 for switching an externally applied reference voltage signal Vref5 based on an external control signal CON1, a second switch S2 for switching an externally applied reference voltage signal VrefO based on an external control signal CON1B, a third switch S3 for switching an externally applied reference voltage signal Vref4 based on the control signal CON1, a fourth switch S4 for switching an externally applied reference voltage signal Vref1 based on the control signal CON1B, a fifth switch S5 for switching an externally applied reference voltage signal Vref3 based on the control signal CON1, a sixth switch S6 for switching an externally applied reference voltage signal Vref2 based on the control signal CON1B, a seventh switch S7 for switching the reference voltage signal Vref2 based on the control signal CON1, an eighth switch S8 for switching the reference voltage signal Vref3 based on the control signal CON1B, a ninth switch S9 for switching the reference voltage signal Vref1 based on the control signal CON1, a tenth switch S10 for switching the reference voltage signal Vref4 based on the control signal CON1B, an eleventh switch S11 for switching the reference voltage signal Vref0 based on the control signal CON1, and a twelfth switch S12 for switching the reference voltage signal Vref5 based on the control signal CON1B.

The power switch 15 further includes a thirteenth switch S13 for switching the signals output from the first and second switches S1 and S2 based on an external control signal CON2, a fourteenth switch S14 for switching the signals output from the third and fourth switches S3 and S4 based on the control signal CON2, a fifteenth switch S15 for switching the signals output from the fifth and sixth switches S5 and S6 based on the control signal CON2, a sixteenth switch S16 for switching the signals outputfrom the seventh and eighth switches S7 and S8 based on the control signal CON2, a seventeenth switch S17 for switching the signals output from the ninth and tenth switches S9 and S10 based on the control signal CON2, an eighteenth switch S18 for switching the signals output from the eleventh and twelfth switches S11 and S12 based on the control signal CON2, and nineteenth to twenty-third switches S19–S23, respectively mounted between first-sixth output terminals V00–V05, for switching the outputs of the thirteenth to eighteenth switches S13–S18 to an equivalent potential of the respective output terminals V00–V05 based on an external control signal CON3.

Figure 6:
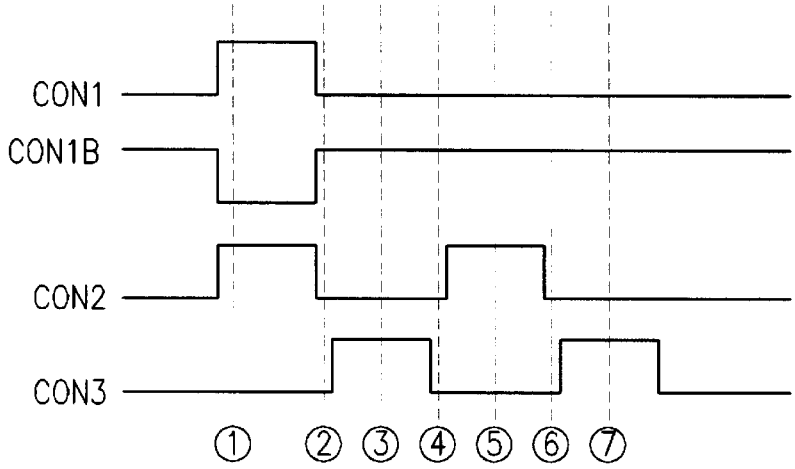
FIG. 6 shows output waveforms of control signals applied to the power switch shown in FIG. 5.

The control signals CON1, CON1B, CON2 and CON3 have relationships with respect to each other as shown in, e.g., FIG. 6. The control signal CON1 is an inverse of the control signal CON1B. The control signal CON3 corresponds to the control signal CON2 delayed by a predetermined time period.

Figure 7:
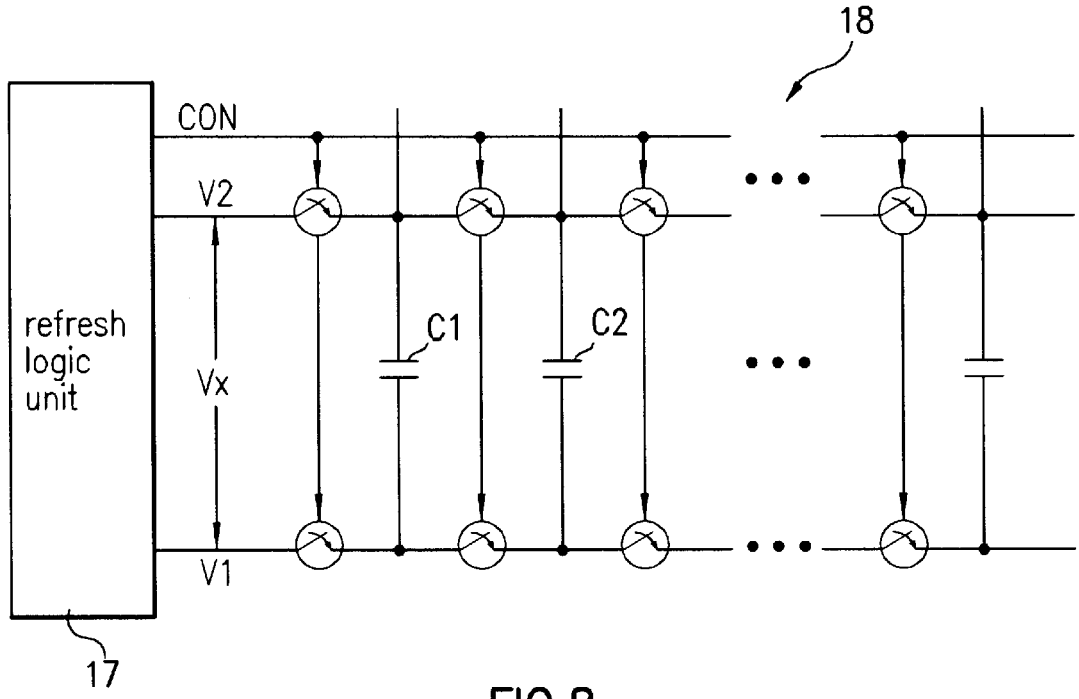
FIG. 7 is a schematic diagram of a refresh logic unit connected to a storage unit of the device in FIG. 3.

The storage unit 18 as shown in FIG. 7 includes a first capacitor C1 in an odd number line, a second capacitor C2 in an even number line, and so forth. One node of the first capacitor C1 is grounded, and the other node of the first capacitor C1 is connected to the output of the corresponding DAC 16*a* and the input terminal of the corresponding buffer 19*a*. The second capacitor C2 for processing positive (+) polarity signals is connected between the output terminal the corresponding DAC 19*a* and the input terminal of the corresponding buffer 19*b*. The storage unit 18 further includes a plurality of switches for selectively charging and discharging the capacitors C1 and C2 based on voltage signals V1 and V2.

The buffer unit 19 amplifies the signals output from the storage unit 18. In the buffer unit 19, there are provided N-buffers 19*b* for amplifying the negative (–) polarity signals processed by the negative (–) polarity signal processor 13*b*, and P-buffers 19*a* for amplifying the positive (+) polarity signals processed by the positive (+) polarity signal processor 13*a*. The respective operation voltages are $V_{SS1}$–$V_{DD1}$ and $V_{SS2}$–$V_{DD2}$ within the range of 5V including negative (–) and positive (+) signals.

Figure 8:
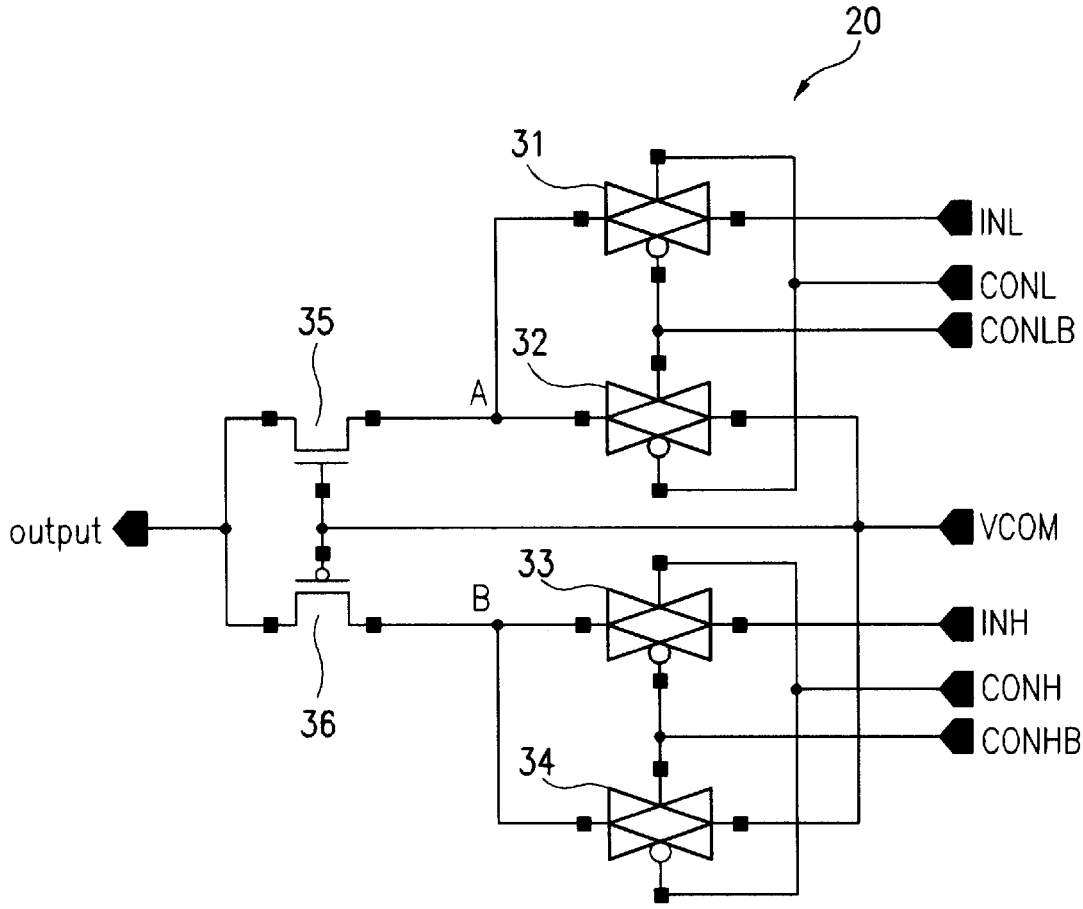
FIG. 8 is a detailed circuit diagram of a switch unit of the device in FIG. 3.

As shown in FIG. 8, the switching unit 20 includes a first transfer gate 31 for switching a low input signal INL based on external low control signals CONL and CONLB, a second transfer gate 32 for switching a common voltage signal VCOM based on the external control signals CONL and CONLB, a third transfer gate 33 for switching a high input signal INH based on external high control signals CONH and CONHB, a fourth transfer gate 34 for switching the common voltage signal VCOM based on the external high control signals CONH and CONHB, an NMOS transistor 35 for switching between the output signals of the first and second transfer gates 31 and 32 based on the common voltage signal VCOM, and a PMOS transistor 36 for switching between the output signals of the third and fourth transfer gates 33 and 34 based on the common voltage signal VCOM.

The operation of the device 100 for driving a TFT-LCD according to the preferred embodiment of the present invention will be described below.

The mixer 11 stores the digital picture signals of a plurality of channels from an external source, such as a controller (not shown), and controls the order in which data are input to the latch unit 13. The mixer 11 outputs the positive (+) polarity signals and the negative (–) polarity signals to the positive (+) polarity signal processor 13*a* and the negative (–) polarity signal processor 13*b* of the latch unit 13, respectively, in response to the polarity signal POL.

In other words, the digital signal of one channel passes through the first and third latches 21 and 23 of the mixer 11. The digital signal of another channel passes through the second and fourth latches 22 and 24 of the mixer 11. Then these digital signals are input to the positive (+) polarity signal processor 13*a* or the negative (–) polarity signal processor 13*b* under control of the multiplexer 25 based on the polarity signal POL.

The shift register unit 12 sequentially outputs pulses having a period equal to a pulse of the clock signal CLK, and enables one of the latches next to the shift register unit 12 to allow the outputs of the mixer 11 to be sequentially input to the latch unit 13.

The latch unit 13 processes the digital signals output from the mixer 11 using the positive (+) polarity signal processor 13*a* and the negative (–) polarity signal processor 13*b* per one channel, and outputs the processed signals to the level shift unit 14. At this time, the signals processed by the positive (+) polarity signal processor 13*a* are output to the level shifters 14*a* in the even number lines, and the signals processed by the negative (–) polarity signal processor 13*b* are output to the level shifters 14*b* in the odd number lines.

The level shift unit 14 shifts the levels of the digital picture signals output from the latch unit 13 from $V_{SS}$–$V_{DD}$ to $V_{SS1}$–$V_{DD1}$ for each of the channels.

As shown in FIG. 9, the power switch 15 outputs the reference voltage signals Vref (Vref0, Vref1 . . . ) in the inverse order based on the clock signal timing diagram shown in FIG. 6. For example, if the control signals CON1 and CON2 are at a high level (e.g., time ①), the reference voltage signals Vref5 to Vref0 are output in that order at the output terminals V05 to V00, respectively. If the control signal CON2 is at a low level and the control signal CON3 is at a high level (e.g., time ③), the reference voltage signals Vref0–Vref5 are shorted. If the control signals CON1B and CON2 are at a high level (e.g., time ⑤), the reference voltage signals Vref5 to Vref0 are output in the reverse order of Vref0 to Vref5, respectively, at the output terminal V05 to V00. If the control signal CON3 becomes high again (e.g., time ⑦), the reference voltage signals Vref0–Vref5 are shorted.

Figure 10A:
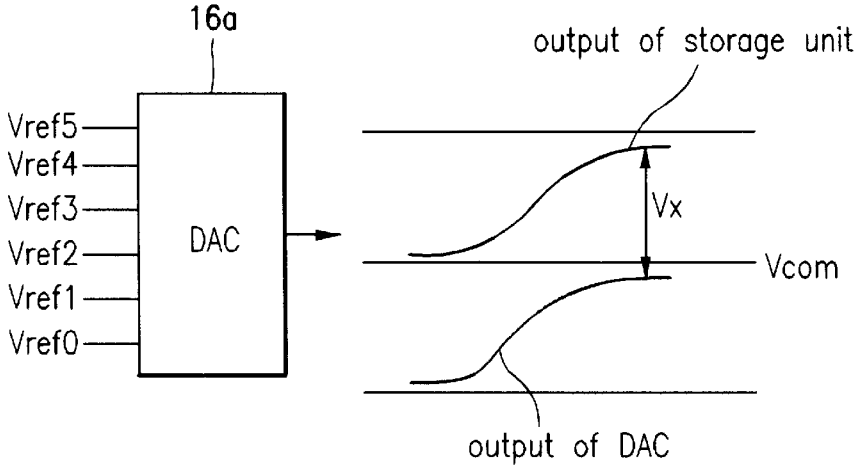
FIGS. 10(*a*) and 10(*b*) are schematic views illustrating an output of a D/A conversion unit and an output of a storage unit of the device in FIG. 3.
Figure 10B:
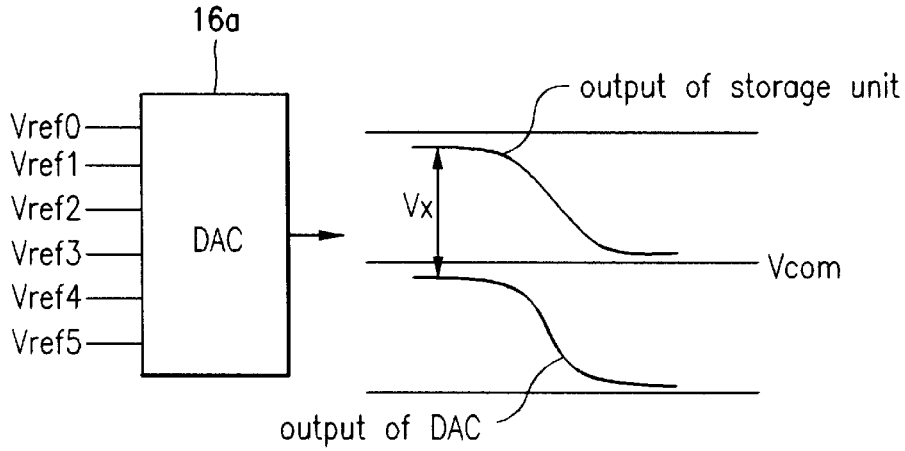

The D/A conversion unit 16 converts the digital signals output from the level shift unit 14 to analog signals based on the reference voltage signals Vref0–Vref5 output from the output terminals V00-V05 of the power switch 15. In other words, as shown in FIGS. 10(*a*) and 10(*b*), signals having opposite phases and the same amplitudes are output from each of the DACs 16*a* based on the input order of the reference voltage signals Vref0–Vref5.

Since one node of the capacitor C1 in the odd number line of the storage unit 18 is grounded and the other node thereof is connected to the output of the corresponding DAC 16*a* of the D/A conversion unit 16 and to the input terminal of the corresponding buffer 19*a*/19*b*, the output of the corresponding DAC 16*a* is transferred to the input terminal of the corresponding buffer 19*a*/19*b*. If the output of the corresponding DAC 16*a* has a high impedance, the previous output voltage is maintained.

The capacitor C2 in the even number line of the storage unit 18 is connected between the output terminal of the corresponding DAC 16*a* and the input terminal of the corresponding buffer 19*a*/19*b*. The potential difference between the ends of the capacitor C2 is maintained at a certain value Vx by the operation of the refresh logic unit 17. The value Vx is added to the output of the corresponding DAC 16*a* to generate a picture signal of positive (+) polarity as shown in FIGS. 10(*a*) and 10(*b*). Therefore, the capacitor C2 serves as a voltage adder for adding the value Vx to the output of the corresponding DAC 16*a* before being transferred to the corresponding P-buffer 19*a*. In the same manner as the capacitor C1, if the output of the corresponding DAC 16*a* has a high impedance, the previous output value is maintained.

The buffer unit 19 amplifies the signals output from the storage unit 18 to generate negative (−) and positive (+) polarity signals.

Finally, each switch 20*a* of the switching unit 20 switches between the positive (+) polarity signal and the negative (−) polarity signal output from the buffer unit 19 in response to the odd and even number lines. In other words, in the dot inversion method according to the present invention, the polarity signals are generated from each of the switches 20*a* in the order of +,−,+,− . . . (polarity) in the odd number lines and in the order of −,+,−,+ . . . in the even number lines.

In this example, the mixer 11 inputs two channel signals so that one channel signal is applied to the positive (+) polarity signal processor 13*a* and the other channel signal is applied to the negative (−) polarity signal processor 13*b*. However, the mixer 11 can input more than two channel signals. The power switch 15 and the D/A conversion unit 16 output the analog signals of corresponding polarity. The storage unit 18 and the refresh logic unit 17 generate positive (+) and negative (−) polarity signals in response to the dot inversion driving method of the present invention. The switching unit 20 switches the polarity order of the channels based on whether the line is an even or odd numbered line.

Thus, the present invention is structured and arranged to provide positive and negative polarity signals without duplicative circuitry. FIG. 3 shows D/A converters 16 which convert level shifted digital input signals into analog signals, and storage unit 18 which passes signals from D/A converters 16 to buffers 19 with the same or inverse polarity. More specifically, storage unit 18 includes capacitors C2 for adding a voltage to some of the signals received from the D/A converters 16, thus converting the polarity of those signals from negative to positive if the voltage being added by the capacitors C2 is positive or from positive to negative if the voltage being added by the capacitors C2 is negative.

The device 100 for driving a TFT-LCD according to the preferred embodiment of the present invention has advantages including the following.

First, since the device 100 according to the present invention can be driven by the voltage of 5V or less, the dot inversion driving circuit can be realized by a typical CMOS process. More specifically, as described above and as illustrated by FIG. 3, the present invention can be driven (e.g., $V_{DS}$ and $V_{GS}$ of MOSFETs) via 5V or less by constituting a TFT-LCD driving circuit for processing and separating a positive (+) polarity signal and a negative (−) polarity signal. For this purpose, the present invention includes a D/A conversion unit 16 and the storage unit 18 as shown in FIG. 3. Therefore, rather than driving a TFT-LCD using a D/A conversion unit for generating positive (+) and negative (−) polarity image signals in the positive (+) and negative (−) polarity processors 13*a* and 13*b*, respectively, the present invention uses a capacitor to convert a negative (−) polarity image signal output from the D/A conversion unit 16 to a positive (+) polarity image signal.

Second, in processing a signal from one channel, the conventional art requires two signal processors and two D/A converters. In contrast, the preferred embodiment of the present invention requires only one D/A conversion unit, thereby reducing the size of the conventional chip.

Finally, since all of the data lines are connected to the common voltage terminal for a certain period of time before being switched to output to the output terminals, a charge sharing effect can be achieved, thereby reducing the power consumption by the device 100.

It will be apparent to those skilled in the art that various modifications and variations can be made in the device and method for driving a TFT-LCD according to the present invention without departing from the spirit or scope of the invention. Thus, it is intended that the present invention cover the modifications and variations of the invention provided they come within the scope of the appended claims and their equivalents.

What is claimed is:

1. A device for driving a liquid crystal display (LCD), comprising:

a digital-to-analog (D/A) conversion unit for converting digital picture signals into analog picture signals;

a storage unit including a plurality of capacitors, each capacitor assigned to a particular signal line and used alone to add a predetermined value to a corresponding output signal of the D/A conversion unit; and a switching unit for generating first and second polarity signals in a predetermined order based on output signals of the storage unit.

2. The device as claimed in claim 1, wherein the capacitors include:

a positive (+) polarity capacitor for processing positive (+) polarity signals included in the output signal of the D/A conversion unit, and a negative (−) polarity capacitor for processing negative (−) polarity signals included in the output signal of the D/A conversion unit; and the device further comprising:

a refresh logic unit for refreshing the positive (+) polarity capacitor to maintain a potential difference between ends of the positive (+) polarity capacitor at a predetermined value.

3. The device as claimed in claim 1, wherein at least one of the D/A conversion unit and the storage unit includes sub-parts corresponding to the number of the plurality of channels, odd number lines of the sub-parts processing negative polarity signals of the digital picture signals, even number lines of the sub-parts processing positive polarity signals of the digital picture signals.

4. The device as claimed in claim 1, further comprising a mixer including:

a first latch device for latching the digital picture signals based on first and second clock signals;

a second latch for latching output signals of the first latch based on the first and second clock signals;

a third latch for latching output signals of the first latch based on third and fourth clock signals;

a fourth latch for latching output signals of the second latch based on the third and fourth clock signals; and a multiplexer for selecting one of the output signals of the third and fourth latches based on polarity control data.

5. The device as claimed in claim 4, wherein a pulse duration of the third clock signal equals two times a pulse duration of the first clock signal.

6. The device as claimed in claim 4, wherein a pulse duration of the fourth clock signal equals two times a pulse duration of the second clock signal.

7. The device as claimed in claim 1, wherein the D/A conversion unit converts the digital signal based on predetermined reference voltage signals; and the device further comprising:

a power switch for generating the predetermined reference voltage signals based on control signals and outputting the generated predetermined reference voltage signals to the D/A conversion unit.

8. The device as claimed in claim 7, wherein the power switch includes:

a first switch for switching a sixth reference voltage signal based on a first control signal;

a second switch for switching a first reference voltage signal based on a second control signal;

a third switch for switching a fifth reference voltage signal based on the first control signal;

a fourth switch for switching a second reference voltage signal based on the second control signal;

a fifth switch for switching a fourth reference voltage signal based on the first control signal;

a sixth switch for switching a third reference voltage signal based on the second control signal;

a seventh switch for switching the third reference voltage signal based on the first control signal;

an eighth switch for switching the fourth reference voltage signal based on the second control signal;

a ninth switch for switching the second reference voltage signal based on the first control signal;

a tenth switch for switching the fifth reference voltage signal based on the second control signal;

an eleventh switch for switching the first reference voltage signal based on the first control signal; and a twelfth switch for switching the sixth reference voltage signal based on the second control signal.

9. The device as claimed in claim 8, the power switch further includes:

a thirteenth switch for switching signals output from the first and second switches based on a third control signal;

a fourteenth switch for switching signals output from the third and fourth switches based on the third control signal;

a fifteenth switch for switching signals output from the fifth and sixth switches based on the third control signal;

a sixteenth switch for switching signals output from the seventh and eighth switches based on the third control signal;

a seventeenth switch for switching signals output from the ninth and tenth switches based on the third control signal; and an eighteenth switch for switching signals output from the eleventh and twelfth switches based on the third control signal.

10. The device as claimed in claim 9, wherein the power switch further includes nineteenth to twenty-third switches, respectively mounted between first to sixth output terminals, for switching the outputs of the thirteenth to eighteenth switches to an equivalent potential of the corresponding output terminal based on a fourth control signal.

11. The device as claimed in claim 1, further comprising:

a buffer unit for amplifying the output signals of the storage unit and outputting the amplified signals to the switching unit.

12. The device as claimed in claim 11, wherein the buffer unit includes:

a plurality of buffers corresponding to a number of the channels, the plurality of buffers including N-buffers for amplifying negative (−) polarity signals output from a negative (−) polarity signal processor of a latch unit, and P-buffers for amplifying positive (+) polarity signals output from a positive (+) polarity signal processor of the latch unit.

13. The device as claimed in claim 11, wherein the switching unit includes:

a first transfer gate for switching a first signal output from the buffer unit based on first and second external control signals;

a second transfer gate for switching a common voltage signal based on the first and second external control signals;

a third transfer gate for switching a second signal output from the buffer unit based on third and fourth external control signals;

a fourth transfer gate for switching the common voltage signal based on the third and fourth external control signals;

an NMOS transistor for switching output signals of the first and second transfer gates based on the common voltage signal; and a PMOS transistor for switching output signals of the third and fourth transfer gates based on the common voltage signals.

14. The device as claimed in claim 1, further comprising:

a mixer providing the digital picture signals; and a latch unit for latching the digital picture signals output from the mixer based on predetermined signals.

15. The device as claimed in claim 14, further comprising:

a shift register unit for generating and sequentially outputting the predetermined signals to the latch unit.

16. The device as claimed in claim 14, further comprising:

a level shift unit for shifting the digital picture signals output from the latch unit to predetermined levels and outputting the shifted signals to the D/A conversion unit.

17. A method for driving a liquid crystal display (LCD), comprising:

temporarily storing, in a mixer, digital picture signals of a plurality of channels;

outputting the stored digital picture signals according to a predetermined order of polarity based on polarity control data;

latching the digital picture signals output from the outputting step based on predetermined pulse signals;

converting the latched digital picture signals into analog signals based on predetermined reference voltage signals;

adding a predetermined value to positive (+) polarity signals of the analog signals using only a single capacitor; and generating the positive (+) polarity signals and negative (−) polarity signals of the analog signals in a predetermined order.

18. The method as claimed in claim 17, further comprising:

shifting the latched digital picture signals to a predetermined level prior to the converting step.

19. The method as claimed in claim 17, wherein, in the adding step, a single positive (+) polarity capacitor processes the positive (+) polarity signals, and a single negative (−) polarity capacitor processes the negative (−) polarity signals.

20. The method as claimed in claim 17, wherein the generating step includes amplifying the positive (+) and negative (−) polarity signals of the analog signals output from the converting step, and generating the amplified positive (+) and negative (−) polarity signals in the predetermined order using a plurality of switches.

21. A device for driving a liquid crystal display (LCD), comprising:

a digital-to-analog (D/A) conversion unit for converting digital picture signals into analog picture signals;

a storage unit for adding a predetermined value to an output signal of the D/A conversion unit; and a switching unit for generating first and second polarity signals in a predetermined order based on output signals of the storage unit, wherein the storage unit includes a plurality of capacitors corresponding to a number of channels, wherein a first node of a first one of the capacitors in the odd number line is grounded and a second node of the first one of the capacitors is connected to a first output terminal of the D/A conversion unit, and a second one of the capacitors for processing the positive (+) polarity signals in the even number line is connected to a second output terminal of the D/A conversion unit.

* * * * *